United States Patent [19]

Crum

[11] 4,216,992

[45] Aug. 12, 1980

[54] UNITIZED CLOSE-TO-THE-WALL RECLINER CHAIR MECHANISM

[75] Inventor: McDonald Crum, Louisville, Ky.

[73] Assignee: Leggett & Platt, Incorporated, Carthage, Mo.

[21] Appl. No.: 972,694

[22] Filed: Dec. 26, 1978

[51] Int. Cl.[2] ..... A47C 1/035

[52] U.S. Cl. ..... 297/85; 297/89; 297/344

[58] Field of Search ..... 297/88, 89, 83–87, 297/68, 344, 340–342

[56] References Cited

U.S. PATENT DOCUMENTS

| | | | |
|---|---|---|---|
| 3,572,823 | 3/1971 | Hampton | 297/85 |
| 3,858,932 | 1/1975 | Crum et al. | 297/83 X |
| 3,958,827 | 5/1976 | Ré | 297/85 X |
| 4,099,776 | 7/1978 | Crum et al. | 297/68 X |
| 4,108,491 | 8/1978 | Rogers, Jr. | 297/85 |

FOREIGN PATENT DOCUMENTS

| | | | |
|---|---|---|---|
| 2812959 | 10/1978 | Fed. Rep. of Germany | 297/89 |
| 2815693 | 11/1978 | Fed. Rep. of Germany | 297/88 |

*Primary Examiner*—William E. Lyddane
*Attorney, Agent, or Firm*—Wood, Herron & Evans

[57] ABSTRACT

A close-to-the-wall recliner chair has a body support, i.e., seat and backrest, which is pivotally mounted on a body support frame, and the body support frame is in turn carried on a stationary chair base by roller and track means, thereby permitting forward/rearward motion of the body support frame on the chair base as the body support moves between upright and reclining positions. This forward and rearward motion is effected by a unitized recliner chair mechanism which comprises (a) a conventional recliner mechanism interconnecting the body support frame and the body support, (b) a conventional track and roller assembly, (c) a novel bracket fixedly interconnecting the rollers of the track assembly to the recliner mechanism, and (d) a novel control linkage connected at one end to the track of the roller track assembly and at the opposite end of the footrest linkage of the recliner mechanism. Intermediate its ends, this control linkage is connected to the roller bracket so that as the footrest is opened or extended, the roller bracket is pulled forwardly on the chair base, and as the footrest is retracted, the roller bracket is pushed rearwardly. The control linkage is oriented in a generally vertical plane, and is positioned so that it is generally hidden from view in the upright and all reclining positions of the chair.

10 Claims, 3 Drawing Figures

UNITIZED CLOSE-TO-THE-WALL RECLINER CHAIR MECHANISM

This invention relates to recliner chairs. More particularly, this invention relates to mechanisms by which recliner chairs are moved between upright and reclining positions.

In general, recliner chairs have always included a body support, i.e., a seat and a backrest, mounted on a stationary base for movement between upright and reclining positions. Within the past several years, so-called close-to-the-wall recliner chairs have become commercially important. These close-to-the-wall recliners mount the formerly stationary base upon rollers and tracks and then cause the base to roll forwardly on the tracks as the body support reclines and to roll rearwardly as the body support moves from the reclined to the upright position. This forward and rearward movement of close-to-the-wall recliners serves to eliminate the need for space behind the chair into which the top of the backrest can move as the backrest tips rearwardly in the course of going into the reclined position.

Examples of close-to-the-wall recliner chairs which may be moved from an upright to a full reclining position without any substantial rearward or aft movement of the backrest or top portion of the chair's backrest, are illustrated and described in U.S. Pat. Nos. 3,858,932 and 4,099,776, both assigned to the assignee of this application. The recliner chairs shown in these patents each mount the chair's body support on a body support frame movably attached to a stationary chair base so that the chair's seat and backrest move forwardly on the chair base as the seat and backrest are tilted into the reclining position from the upright position. The forward/rearward distance that the body support frame moves over the chair base is controlled through a control assembly so that, with the backrest located in the full reclining position, little or no space is required behind the backrest to allow for the body support's reclining movement. The control assembly shown in U.S. Pat. No. 3,858,932 interconnects the stationary chair frame and the body support's backrest, and basically includes an extended length strut/track structure that stretches from the chair base along the outside edges of the backrest on each side thereof up adjacent to the backrest's headrest portion. The control assembly shown in U.S. Pat. No. 4,099,776 interconnects the stationary chair frame and the chair's recliner linkage assembly, and is oriented in a generally horizontal plane underneath the chair's seat.

A characteristic of the close-to-the-wall recliner chairs shown in U.S. Pat. Nos. 3,858,932 and 4,099,776 and of all other prior art close-to-the-wall recliners of which we are aware, is that they all mount the roller and track assembly on the chair frame independently of the recliner mechanism. In other words, these two separate assemblies are manufactured and shipped by a metal fabricator to the chair manufacturer as separate assemblies which are then mounted to the chair frame as separate assemblies. Only after the two assemblies are attached to the chair frame, are they interconnected. Because the two assemblies are manufactured and assembled separately, they contribute very little to either the lateral or front to rear stability of the recliner.

One objective of this invention has been to provide an improved close-to-the-wall recliner mechanism which contributes significantly and improves the lateral stability as well as the front and rear stability of the chair manufactured from the mechanism. This objective is achieved by the practice of this invention in which the recliner mechanism and the roller track assembly are manufactured and fabricated as a single unitary or so-called unitized assembly interconnected and tied together by metal parts such that they contribute significantly to the stability of the chair manufactured from the total assembly.

Specifically, the unitized recliner chair mechanism of this invention comprises a conventional recliner mechanism including a footrest linkage interconnected to the roller track assembly by a metal bracket which may be an extension of the chair frame mounting bracket of the recliner mechanism. The rollers of the roller track assembly are fixedly mounted upon this metal bracket and are slidable within the track. The track and footrest linkage are interconnected by a novel control linkage which is connected at one end to the track and at the opposite end to the footrest linkage. Intermediate its ends the control linkage is connected to the roller bracket so that as the footrest is opened or extended, the roller bracket is pulled forwardly and as the footrest is retracted the roller bracket is pushed rearwardly.

In addition to the improved stability which the unitized recliner mechanism of this invention imparts to the resulting chair, this invention also facilitates faster installation of the mechanism into the chair by the chair manufacturer, thereby reducing the total cost of the chair. Additionally, this invention provides a greater firmness or stability of the footrest of the chair than has heretofore been imparted to prior art close-to-the-wall recliners. This invention also has the advantage of requiring fewer inventory parts by the chair manufacturer who now needs only one pair of unitized recliner mechanisms to construct the chair.

Another advantage of the recliner mechanism of this invention is that it includes a novel and simplified control linkage for a close-to-the-wall recliner chair, which linkage is all oriented in a generally vertical plane and positioned so that it is generally hidden from an observer's view in the upright and all reclining positions of the chair. This linkage is safer than prior art exposed mechanisms and is less subject to breakage or failure than many prior art linkage systems.

Other objectives and advantages of this invention will be more apparent from the following detailed description taken in conjunction with the drawings in which.

Figure 1:
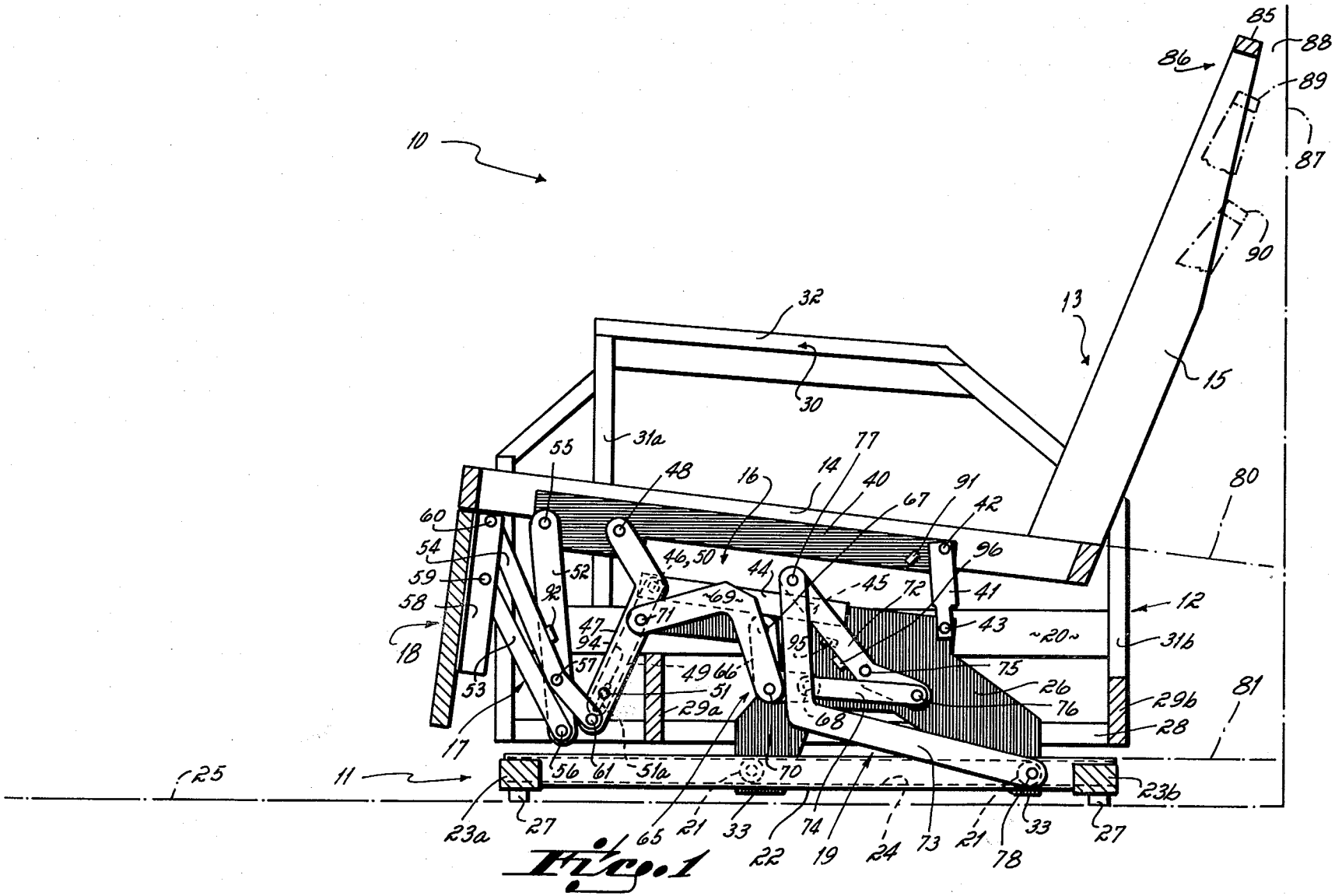
FIG. 1 is a side view illustrating a simplified control linkage for a recliner chair in accord with the principles of this invention, the recliner chair being shown in the upright attitude.

The recliner chair 10 basically includes a stationary chair base 11 and a body support frame 12 mounted for sliding movement on the stationary base. A body support 13, including seat 14 and backrest 15, is pivotally mounted in the body support frame 12 by recliner linkage assembly 16. A leg rest linkage assembly 17 connects leg rest 18 with the recliner linkage assembly 16. Control linkage assembly 19 controls the forward/rearward motion of the body support frame 12 on the chair base 11 as the body support 13 moves between the upright portion shown in FIG. 1 and the full reclining position shown in FIG. 3. The recliner linkage assembly 16, leg rest linkage assembly 17 and control linkage assembly 19, illustrated in the figures is found on each side of the chair even though the structure for only one side is shown. In other words, the recliner linkage assembly 16, leg rest linkage assembly 17 and control linkage assembly 19 are duplicated on opposed sides of the chair (only one side being shown in the drawings for purposes of illustration). Each recliner linkage assembly 16 connects the base 11 and body support frame 12 on each side of the chair, each leg rest linkage assembly connects the leg rest 18 and recliner linkage assembly 16 on each side of the chair, and each control linkage assembly 19 connects with the base 11, body support frame 12 and recliner linkage assembly 16 on each side of the chair. Further, and although the figures only show the framework for the body support frame 12 and body support 13, it will be understood that such framework is suitably adapted for receiving appropriate spring elements, cushioning, upholstery, or the like for completion of a saleable product, i.e., the springs, cushioning and covering of the chair have been eliminated for clarity of illustration of the improvement of this invention.

The stationary chair base 11 includes parallel and spaced side rails (one of which is shown at 22) which are interconnected by front and rear cross rails 23*a*, 23*b*. Tracks 24 (one of which is shown), parallel to the floor 25, are mounted in fixed relation to the base's spaced side rails 22, the tracks being adapted to receive rollers 21 fixed on each mount plate 26 which is part of body support frame 12, thereby mounting the body support frame 12 in movable or slidable relation relative to the chair base 11. Four legs 27 (two of which are shown) are disposed at the four corners of the chair base 11 to support the base above floor 25 level.

The body support frame 12, as previously mentioned, provides the pivotal mount base for the body support 13. The body support frame 12 itself includes parallel and spaced side rails (one of which is shown at 28, and to which mount plate 26 is fixed) which are interconnected by front 29*a* and rear 29*b* cross rails. An armrest frame 30 extends vertically upward from each of the body support frame's side rails 28. Each armrest frame 30 includes generally vertically extending front 31*a* and rear 31*b* armrest posts fixed at their bottom ends to a side rail 28 and interconnected at their top end by an armrest rail 32. A longitudinal brace 20 is interconnected between the front 31*a* and rear 31*b* armrest posts approximately midway, top to bottom, of each armrest frame 30. The mount plate 26 for the linkage system 16, 17, 19 is also fixed to this cross brace 20. Each armrest frame 30 is adapted to receive padding and a covering, not shown, to provide a saleable chair.

The body support 13 includes the seat 14 and backrest 15, both of which are shown in the nature of framework adapted to receive springs, cushioning, and a covering, not shown, to provide a saleable chair. The body support 13 is connected to the body support frame 12, on each side thereof, through the recliner linkage assembly 16. Mount plate 26 of each recliner linkage assembly 16 is fixed to the adjacent armrest brace member 20 and side rail 28, and the chair's seat 14 is fixed to the adjacent body support plate 40 of each recliner linkage assembly 16, thereby pivotally connecting the body support 13 to the body support frame 12. Front and rear rollers 21 are fixed to a leg 33 that depends from the mount plate 26, those rollers being received within tracks 24 fixed to the chair base 11, thereby permitting the forward/rearward motion of the body support frame 12 relative to the chair base as previously mentioned. Thus, the armrests 30, body support 13 and body support frame 12 are all movably supported on the stationary chair base 11 by rollers 21 within the chair base's tracks 24, thereby permitting forward and rearward movement of the body support frame 12 and those of the chair's structural elements connected to it.

Figure 2:
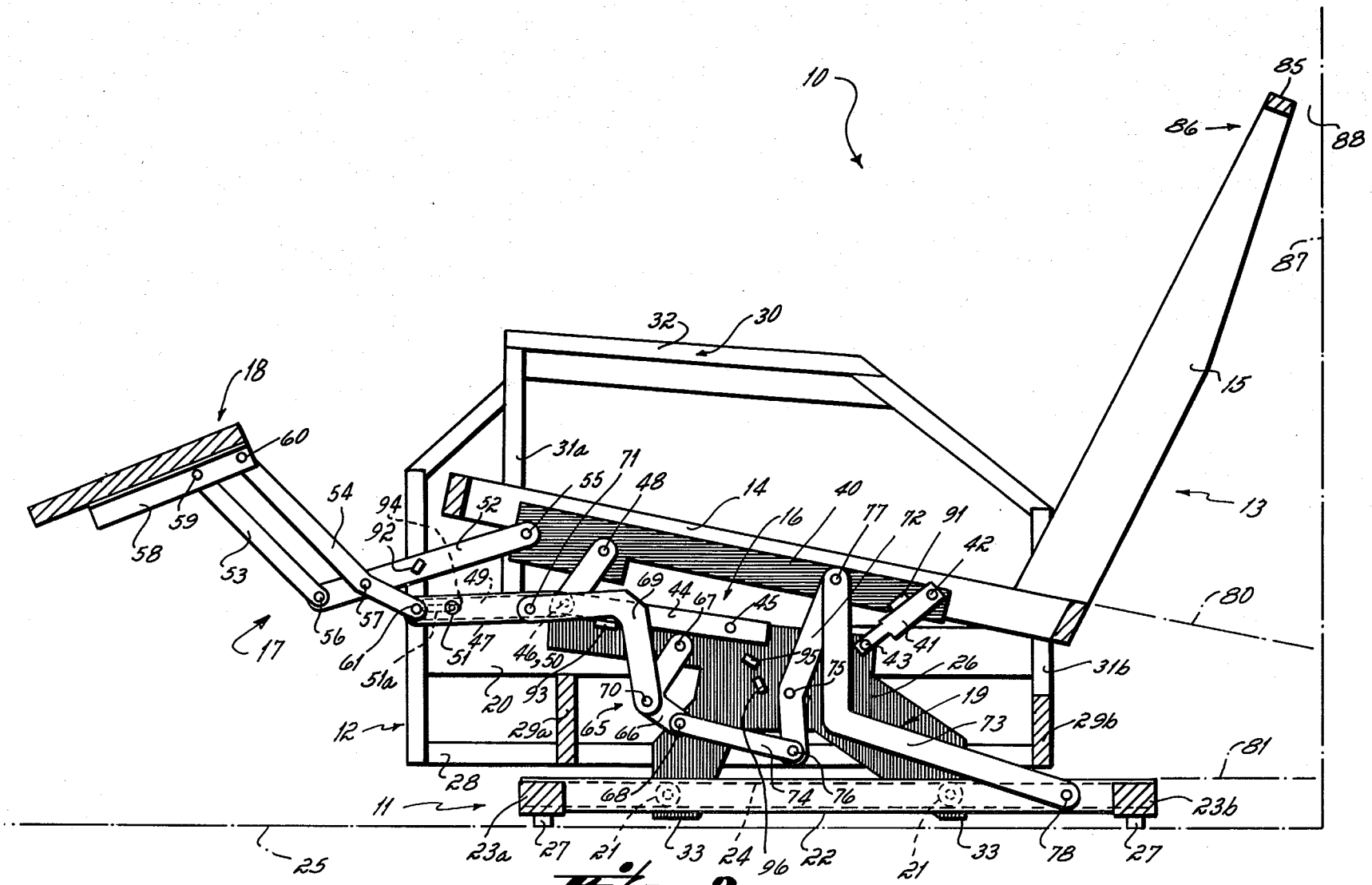
FIG. 2 is a side view similar to FIG. 1 but showing the recliner chair in the intermediate reclining or TV position with the chair's leg rest extended.
Figure 3:
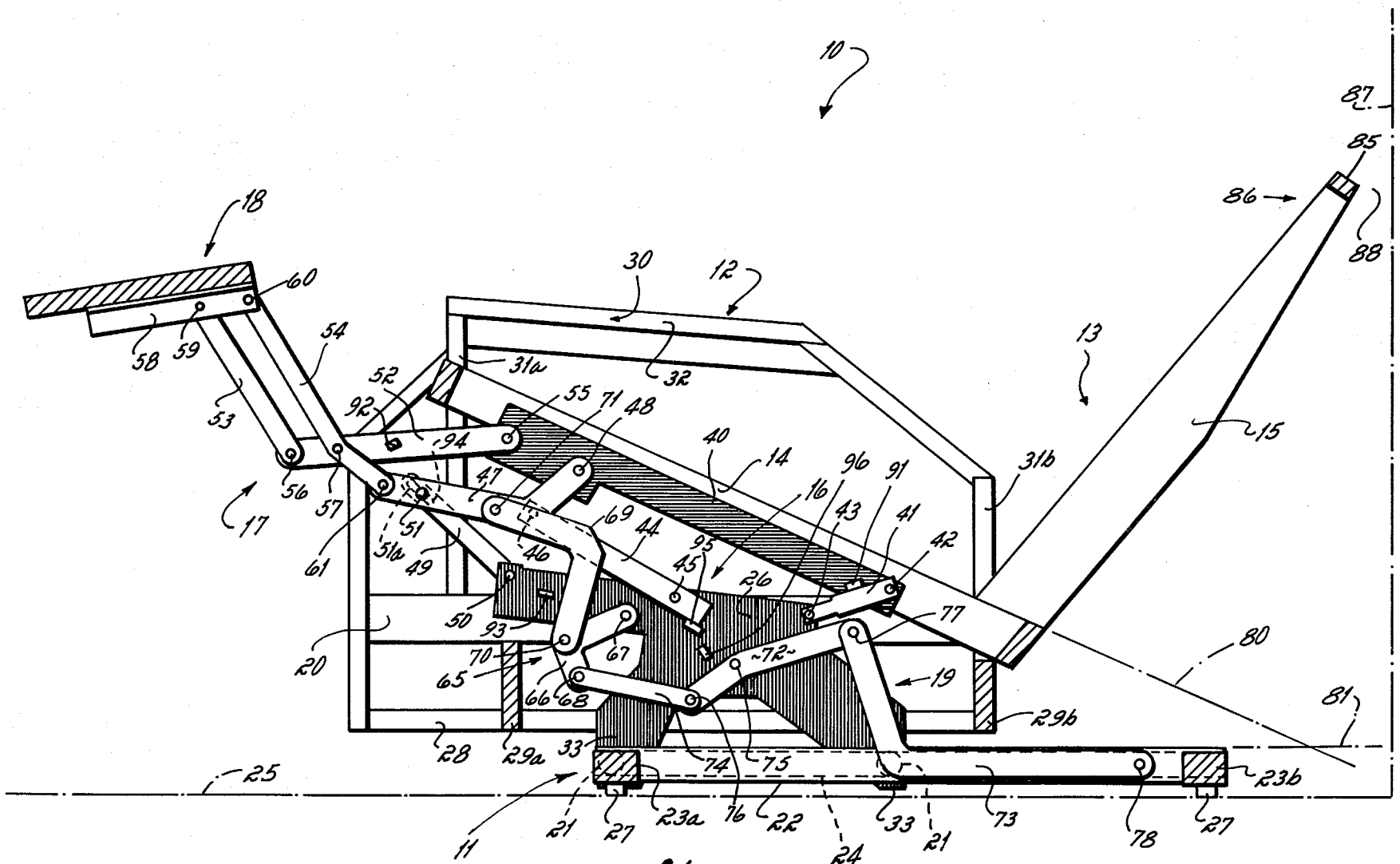
FIG. 3 is a side view similar to FIGS. 1 and 2 but showing the reclining chair in the full reclining position.

The recliner linkage assembly 16 for the body support 13, and leg rest linkage assembly 17 for the leg rest 18 are operatively connected together, and are known per se to the prior art. The combined recliner 16 and leg rest 17 linkage means operatively interconnects the chair's movable body support frame 12 with its body support 13 for moving the body support from an upright position (as shown in FIG. 1) to an intermediate reclining or TV position (as shown in FIG. 2) to a full reclining position (as shown in FIG. 3), and operatively interconnects the leg rest 18 with the body support frame 12 and body support 13 for moving the leg rest from a generally vertical storage position (as shown in FIG. 1) to a horizontal use position (as shown in FIGS. 2 and 3). The body support frame 12, and, hence, the armrests 30, moves forwardly relative to the base 11 as the body support 13 moves from the upright position shown in FIG. 1 to the full reclining position shown in FIG. 3, and moves rearwardly relative to the chair base as the body support moves from the full reclining position to the upright position.

Each recliner linkage assembly 16 includes the body support plate 40 attached to the seat 14, and the mount plate 26 attached to an adjacent armrest's brace member 20 and rail 28. An intermediate tilt link 41 is pivotally connected at its upper end to the body support plate 40 as at 42, and is pivotally connected at its lower end to the mount plate 26 as at 43. A tilt limit link 44 is pivotally connected toward, but not at, its rear end as at 45 to the mount plate 26 and is pivotally connected at its front end as at 46 to a locater link 47 at a position between the ends of that link 47. The locater link 47 is pivotally connected as at 48 to the body support plate 40 at its upper end. A lock link 49 is pivotally connected to the mount plate 26 at one end as at 50, and receives stud 51 (fixed to locater link 47 toward the end thereof opposite pivot 48 and beyond pivot 46) in lost motion slot 51*a* at its other end.

Each leg rest linkage assembly 17 is in the form of a double V lazy tong linkage of the conventional overlapped V-type. The leg rest linkage 17 includes lower extension of the locater link 47, and links 54–52. These links 47, 52–54 are arranged so that links 52 and 53 form one V, and so that links 47 and 54 form another V. The link 52 is pivotally connected at one end to body support plate 40 as at 55, is pivotally connected at the other end to link 53 as at 56, and has a mid-portion pivotally connected to the crossing link 54 as at 57. The link 54 is pivotally connected intermediate its ends to the link 52 as at 57, and is pivotally connected at its lower end to the bottom of locater link 47 as at 61. The links 53 and 54 are pivotally connected to leg rest frame 58, as at 59 and 60, respectively.

The recliner linkage 16 and leg rest linkage 17 assemblies are, as previously mentioned, carried by and mounted to the body support frame 12 and body support 13 as shown in FIGS. 1–3. The recliner linkage assembly 16 is directly connected through the legrest linkage 17 and control linkage assembly 19 with the stationary chair base 11.

The control linkage assembly 19 is mounted on the body support frame mount plate 26 and is connected at one end to the base track 24 and the opposite end to the footrest linkage 17. As explained more fully hereinafter, this control linkage assembly 19 is operable when the legrest is extended, to pull the body support mount plate 24, and thus the body support frame 12 to which the plate 24 is attached, forwardly. When the legrest is retracted, the control linkage assembly 19 is operable to push the mount plate 24 and thus the attached body support frame 12 rearwardly relative to the stationary base 11. Since the legrest movement occurs concomitantly with and as a consequence of reclining movement of the body support 13, this forward and rearward movement of the body support frame 12 effected by the control linkage assembly 19 also occurs concomitantly and as a consequence of movement of the body support 13 between upright and reclined positions. The control linkage assembly includes a bellcrank 66 pivotally mounted at one end as at 67 to the mount plate 26, and pivotally mounted at the other end as at 68 to the control linkage 19. It also includes a substantially right angle configured arm 69 pivotally connected at one end as at 70 to the elbow of the bellcrank 66, and pivotally mounted at the other end as at 71 to the locater link 47 between pivot points 46 and 61 on that link 47.

The control linkage 19 further includes a transfer link 72 pivotally mounted as at 75 to the mount plate 26, the transfer link being slightly doglegged in configuration. The short end of the transfer link 72 is pivotally connected to a connector link 74, the connector link 74 being pivotally connected to the bellcrank 66 as at 68, and being pivotally connected as at 76 to one end of the transfer link 72. A control link 73 is pivotally connected as at 77 to the other end of the transfer link 72. The control line 73 is of a bellcrank or angular configuration, the short end of the control link 73 being pivotally connected to the transfer link as at 77 and the long tail end of the control link being pivotally connected to frame slide rail 22 of the chair base 11 as at 78. Thus, the control linkage assembly 19 is pivotally connected as at 75 to the mount plate 26 for the recliner linkage 16 and for the legrest extension linkage 17, and is pivotally mounted to the base frame track 24 on pivot 78. Note, as illustrated in the figures, that the control linkage 19 is oriented in a generally vertical plane relative to ground 25, i.e., no part of the control linkage is oriented in a generally horizontal plane. In this connection, therefore, and during operation of the chair, all of the links 66, 69, 74, 72 and 73 pivot or move in a generally vertical plane only. Further in this regard, note that all pivot connections 71, 70, 67, 68, 76, 75, 77, 78 of the control linkage 19 are on substantially horizontal axes; such permits the control linkage 19 to be fabricated as a generally planar linkage structure and permits the control linkage to be oriented in position in the generally vertical plane previously referred to.

When the chair is viewed from the side by an observer (as shown in the figures), and when the chair is fully upright as shown in FIG. 1, note that all link components of the control linkage 19 are disposed beneath the plane 80 of the chair's seat 14, and within the confines of the body support frame 12, thereby hiding the control linkage from the observer's view because the armrest frame 30 is fully upholstered as previously mentioned. Also, when viewed from the side, and when the recliner chair is in the intermediate or TV position shown in FIG. 2, the control linkage 19 remains generally confined beneath the plane 80 of the chair's seat 14. When the recliner chair is extended to the fully reclining position shown in FIG. 3, and when viewed from the side, the control linkage 19 remains beneath the plane 80 of the chair's seat 14 but the long tail end of control link 73 extends rearward of the body support frame 12. But the control link 73 is so configured that, when the recliner chair is in the fully reclining position shown in FIG. 3, the long end of the control link 73 is disposed beneath the top plane 81 of the base frame 11, thereby hiding that link from the observer's view when the recliner chair is viewed from the side as shown in that FIG. 3. Thus, the control linkage 19 is generally hidden from view when the chair 10 is viewed from the side in all of the three primary operation positions of that chair whether that chair is in the upright (see FIG. 1), intermediate reclining (see FIG. 2), or fully reclining (see FIG. 3) position. In preferred form, the various links 69, 66, 72, 73 and 74 of control linkage 19 of this invention are sized relative one to the other, and are pivotally connected to the body support frame and to the chair base in such a manner that the body support frame 12 moves forward from its upright position to its reclining position an overall distance that retains the top and aftmost edge 85 of the backrest 15 in a clearance 88 with, e.g., an adjacent wall 87.

In use, and when a user is seated in the recliner chair, it may be activated in a two-step sequence from the upright position illustrated in FIG. 1 to an intermediate reclining or TV position illustrated in FIG. 2 and then to a full reclining position illustrated in FIG. 3. In translating the chair between the FIGS. 1, 2 and 3 positions, the improved control linkage 19 of this invention functions to maintain the aftmost edge 85 of the chair's headrest portion 86 outwardly away from a wall 87 against which the chair 10 may be positioned, i.e., prevents the chair's backrest from tilting backwardly into the wall and thereby prevents that wall from impeding the reclining action of the chair's body support 13. Note that gap 88 is provided between the headrest edge 85 and wall 87 when the chair 10 is upright as shown in FIG. 1, that gap 88 remaining substantially the same when the chair is in an intermediate reclining position, and when the chair is in the full reclining position, compare phantom line positions 89, 90 of the chair in the latter two positions as shown in FIG. 1.

With a user seated in the reclining chair 10, and to translate the chair from the FIG. 1 attitude to the FIG. 2 attitude, the user pushes forward on the chair's armrests 32 and, hence, backward against the chair's backrest 15. The force reaction between the armrests 32 and backrest 15 causes the body support to pivot about pivot points 42, 43 defined by the pivotal connections of the intermediate tilt link 41 with the mount plate 26 and the body support plate 40 until the intermediate tilt link abuts against stop 91 on the body support plate, thereby locating the body support 13 in the intermediate reclining position. This force reaction between the armrests 32 and backrest 15 also activates the double V lazy tong leg rest linkage 17 to extend the leg rest 18 from a vertical storage or upright position (as so located by stop 92 on link 52) into the intermediate position shown in FIG. 2. Extension of the leg rest linkage also induces forward motion of the body support frame 12 on the stationary base 11. The forward motion of the body support frame 12 on the stationary base 11 is controlled by the control linkage 19. Such forward motion from the FIG. 1 upright to the FIG. 2 intermediate attitude is effected by bellcrank 66, angle arm 69 and links 74, 72 and 73 pulling the pivot point 75 of link 72 and thus the pivot point 75 mounting plate 26 forwardly. The limit of the forward motion of the body support frame mounting plate 26 is controlled by the linkage 19.

As the leg rest 18 is extended from the FIG. 1 to the FIG. 2 attitude the body support 13 is prevented from further reclining movement (after the intermediate tilt link 41 abuts stop 91) by the lock link 49 because the lock link maintains tilt limit link 44 in seated relation on stop 93 during extension of the leg rest linkage 17. Such is accomplished because stud 51 on the locater link 47 abuts against end 94 of the pivotal slot 51*a* of the lock link 49 (and, thereby, to prevent further reclining motion of the body support 13 itself), during the FIG. 1 to FIG. 2 reclining step. Note that, in the FIG. 1 to FIG. 2 step, the body support frame 12 has moved forward relative to the chair frame 11 a distance sufficient to maintain the gap 88 between the chair's headrest edge 85 and the wall 87 (see phantom line position 89 in FIG. 1). The FIG. 2 attitude is generally known as the TV attitude in that the legrest and body support 13 positions shown in that figure are considered ideal by some users for viewing television.

When the recliner chair is to be reclined further from the FIG. 2 to the FIG. 3 attitude, such as might be done when the chair is to be used by the user for taking a nap, the user pushes again on the chair's armrests 32 and leans back on the backrest 15. Such causes the body support plate 40 and, hence, the seat 14 and backrest 15, to pivot about now fixed pivot point 43 until the tilt limit link 44 abuts stop 95 on the mount plate 26. Leg rest 18 is moved slightly upward as the body support 13 is tilted rearward during motion from the intermediate to full reclining position, but the leg rest 18 is maintained in its fixed relation vis-a-vis the body support plate 40 because lock link 49 is no longer retained in parallel or lock relation with locater link 47, i.e., because locater link stud 51 moves out into the lock link's lost motion slot 51*a*. This further pivoting of the body support 13 about pivot point 43 causes the body support frame 12 to be pulled further forward relative to the stationary chair base 11, the forward motion of the frame 12 again being limited and defined by linkage 69, 66, 72, 73 and 74. As was the case with the tilting motion of the body support 13 from the FIG. 1 to the FIG. 2 attitude, and as is the case with the tilting motion of the body support from the FIG. 2 to the FIG. 3 attitude, the clearance gap 88 is maintained between the aftmost edge 85 of the headrest 86 and the wall 87 through the control linkage 19. The motion of the transfer link 72 and the control link 73 in the control linkage 19 is actuated, therefore, by the extension/retraction motion of the leg rest linkage 17, and the control linkage 19 then, in turn, controls the position of the backrest's aft edge 85 vis-a-vis the wall 87 because the control linkage 19 controls the forward/rearward position of the body support frame 12 vis-a-vis the stationary frame 11. When the chair is returned to the full upright position from either of the reclined positions shown in FIGS. 2 or 3, the chair's body support frame 12 (and, hence, the chair's backrest 15) is located or positioned relative to wall 87 by transfer link 72 abutting control stop 96 fixed to mount plate 26. In this control linkage 19 structure, therefore, the control linkage 19 cooperates with a mount plate stop 96 to locate the chair's complete linkage mechanism 16, 17 and 19 in the full upright position.

The improved control linkage 19 of this invention has been shown in operable combination with a recliner linkage 16 that tilts a one-piece body support 13, i.e., a one-piece seat 14 and backrest 15 combination. In other words, the improved control linkage 19 of this invention functions with that specific recliner linkage 16 as well as with any recliner linkage of the type in which the backrest 15 and seat 14 are fixed one to the other. As previously mentioned, the specific recliner linkage assembly 16 is well known to the prior art. There is also known to the prior art recliner linkages (not shown) which are operable with body supports (not shown) where the backrest and seat are pivotally connected one to the other. In this latter type recliner linkage, the backrest pivots relative to the seat so that it may be moved further toward a horizontal position when fully reclined. The type of recliner linkage assembly which provides this still further reclining or bed-like position of the chair may also be used in structural combination with the novel control linkage 19 of this invention. A typical embodiment of this latter type recliner linkage assembly is illustrated in U.S. Pat. No. 3,572,823.

Irrespective of whether the invention of this application incorporates as a part of the combination a so-called "two-way" recliner linkage 16 of the type illustrated in the drawings for connecting a fixed seat and backrest body support to a body support frame or a so-called "three-way" recliner linkage of the type used for connecting a relatively pivoted seat and backrest body support to a body support frame, the mechanism may incorporate the "unitized" construction of this invention. In other words, the recliner linkage including the footrest actuating mechanism may be permanently attached to the roller track assembly through a bracket or an extension of the body supporting metal frame plate 26. This bracket or extension is fixed to the body supporting frame plate 26 and extends downwardly from the plate 26. The rollers 21 of the roller track assembly are attached to the lower end of the bracket or plate extension 26 and are permanently mounted in the track 24 of the metal side rails 22 so that the recliner mechanism and roller track assembly are a unitized assembly to which the control linkage 19 is permanently connected.

The advantage of this unitized construction is that all of the metal parts of the assembly are interconnected and may be manufactured by the mechanism manufacturer as a unitized metal assembly. The chair manufacturer thus receives only two mechanisms, one for each side of the chair and needs to inventory only two metal assemblies for each chair. This construction has the advantage of being more easily and quickly mounted upon the chair frame. But, the major advantage of this unitized chair mechanism construction is that the resulting chair has substantially greater lateral and forward and backward stability than previous close-to-the-wall chairs in which the roller and track assembly was manufactured and assembled on a chair frame as a separate mechanism from the recliner mechanism.

Having described in detail the preferred embodiment of my invention, what I desire to claim and protect by Letters Patent is:

1. A close-to-the-wall reclining chair of the type including a body support mounted on a body support frame, said body support comprising a chair seat and a chair backrest, recliner linkage connecting said body support and body support frame to permit limited tilting movement of said body support between an upright and at least one reclining position, and a stationary chair base frame on which said body support frame is mounted for forward and rearward motion relative to said chair base frame, the improvement comprising a unitized and all fixedly interconnected reclining chair operating mechanism on each side of said chair for operating said chair, said operating mechanism including said recliner linkage, said recliner linkage including a mount plate fixedly secured to said body support frame, said operating mechanism further including a roller and track assembly operable between said base frame and body support frame to permit said body support frame to move forwardly and rearwardly relative to said base frame, said roller and track assembly including a track and a plurality of rollers movable within said track, one of said rollers and track being fixedly attached to said recliner linkage mount plate independently of the body support frame such that said roller and track assembly and said recliner linkage are a unitary assembly, and a control linkage operatively interconnected between said track and said recliner linkage, said control linkage being operative to effect movement of said body support frame on said chair base frame in response to tilting movement of said body support relative to said body support frame.

2. The reclining chair of claim 1 in which said control linkage is positioned entirely beneath a phantom plane that includes the top surface of said seat when said chair is in the upright position and in the reclining position.

3. The reclining chair as set forth in claim 1 in which the rollers of said roller and track assembly are mounted for rotation upon a plate which is fixedly secured to, or an extension of, said recliner linkage mount plate.

4. The recliner chair as set forth in claim 1 in which said recliner linkage includes a footrest actuator linkage, and said control linkage is connected to said recliner linkage through said footrest actuator linkage.

5. The recliner chair as set forth in claim 1 in which said recliner linkage and said control linkage each including at least one link pivotally connected to said mount plate, and an upright locater stop fixed to said mount plate and engageable with said control linkage to locate said mechanism in the upright position of said chair.

6. A close-to-the-wall reclining chair of the type including a body support mounted on a body support frame, said body support including a chair seat and a chair backrest, recliner linkage connecting said body support and body support frame to permit limited movement of said body support between an upright and at least one reclining position, and a stationary chair base on which said body support frame is mounted for forward and rearward motion relative to said chair base, the improvement comprising a control linkage comprising a plurality of links connected one to another by pivotal connections in a mechanical linkage series between said chair base and said recliner linkage, said control linkage being operative through coaction with said recliner linkage to control forward and rearward movement of said body support frame relative to said stationary base as said body support moves between upright and reclining positions, said control linkage being entirely positioned beneath a phantom plane that includes the top surface of said seat in all of the upright and reclining positions of said chair, and said control linkage being oriented in a generally vertical plane relative to the surface on which said chair base is located in all of the upright and reclining positions of said chair, said recliner linkage including a footrest actuator linkage, said control linkage being connected to said recliner linkage through said footrest actuator linkage, said control linkage also being connected to said chair base and to said footrest actuator linkage by pivotal connections, all of said pivotal connections defining pivot axes that are generally horizontally oriented, and said control linkage including a transfer link and a control link, said transfer link being pivotally connected intermediate its ends to said body support frame, and said control link being pivotally connected at one end to said chair base and pivotally connected at the other end to said transfer link.

7. A close-to-the-wall reclining chair of the type including a body support mounted on a body support frame, said body support comprising a chair seat and a chair backrest, recliner linkage connecting said body support and body support frame to permit limited tilting movement of said body support between an upright and at least one reclining position, and a stationary chair base frame on which said body support frame is mounted for forward and rearward motion relative to said chair base frame, the improvement comprising a unitized reclining chair operating mechanism on each side of said chair for operating said chair, said operating mechanism including said recliner linkage, said recliner linkage including a mount plate fixedly secured to said body support frame, said operating mechanism further including a roller and track assembly operable between said base frame and body support frame to permit said body support frame to move forwardly and rearwardly relative to said base frame, said roller and track assembly including a track and a plurality of rollers movable within said track, one of said rollers and track being fixedly attached to said recliner linkage mount plate such that said roller and track assembly and said recliner linkage are a unitary assembly, and a control linkage operatively interconnected between said track and said recliner linkage, said control linkage being operative to effect movement of said body support frame on said chair base frame in response to tilting movement of said body support relative to said body support frame, said control linkage comprising a plurality of links connected one to another by pivotal connections, said control linkage also being connected to said track and to said recliner linkage by pivotal connections, all of said pivotal connections defining pivot axes that are horizontally oriented.

8. A close-to-the-wall reclining chair of the type including a body support mounted on a body support frame, said body support comprising a chair seat and a chair backrest, recliner linkage connecting said body support and body support frame to permit limited tilting movement of said body support between an upright and at least one reclining position, and a stationary chair base frame on which said body support frame is mounted for forward and rearward motion relative to said chair base frame, the improvement comprising a unitized reclining chair operating mechanism on each side of said chair for operating said chair, said operating mechanism including said recliner linkage, said recliner linkage including a mount plate fixedly secured to said body support frame, said operating mechanism further including a roller and track assembly operable between said base frame and body support frame to permit said body support frame to move forwardly and rearwardly relative to said base frame, said roller and track assembly including a track and a plurality of rollers movable within said track, one of said rollers and track being fixedly attached to said recliner linkage mount plate such that said roller and track assembly and said recliner linkage are a unitary assembly, and a control linkage operatively interconnected between said track and said recliner linkage, said control linkage being operative to effect movement of said body support frame on said chair base frame in response to tilting movement of said body support relative to said body support frame, said control linkage including a transfer link and a control link, said transfer link being pivotally connected intermediate its ends to said body support mount plate and said control link being pivotally connected at one end to said track and pivotally connected at the other end to said transfer link.

9. The recliner chair of claim 8 in which said control linkage further includes at least two bellcrank shaped links connected in series between said transfer link and said recliner linkage.

10. The recliner chair of claim 9 in which said recliner linkage includes a footrest actuator linkage, and one of said bellcrank shaped links of said control linkage is connected to said footrest actuator linkage.

* * * * *